US006237647B1

(12) United States Patent
Pong et al.

(10) Patent No.: US 6,237,647 B1
(45) Date of Patent: May 29, 2001

(54) AUTOMATIC REFUELING STATION

(76) Inventors: William Pong, 49 Buckmaster Dr., Concord, MA (US) 01742; Edward Fredkin, 166 Hyslop Rd., Brookline, MA (US) 02146

( * ) Notice: Subject to any disclaimer, the term of this patent is extended or adjusted under 35 U.S.C. 154(b) by 0 days.

(21) Appl. No.: 09/286,237

(22) Filed: Apr. 5, 1999

Related U.S. Application Data

(60) Provisional application No. 60/080,866, filed on Apr. 6, 1998.

(51) Int. Cl.[7] ..... B67D 5/00
(52) U.S. Cl. ..... 141/94; 141/98; 141/231
(58) Field of Search ..... 141/94, 98, 231

(56) References Cited

U.S. PATENT DOCUMENTS

| | | | | |
|---|---|---|---|---|
| 3,642,036 | | 2/1972 | Ginsburgh et al. | 141/94 |
| 4,881,581 | | 11/1989 | Hollerback | 141/113 |
| 5,249,612 | * | 10/1993 | Parks et al. | 141/94 |
| 5,383,500 | | 1/1995 | Dwars et al. | 141/98 |
| 5,394,330 | * | 2/1995 | Horner | 701/101 |
| 5,404,923 | * | 4/1995 | Yamamoto et al. | 141/94 |
| 5,609,190 | * | 3/1997 | Anderson et al. | 141/59 |
| 5,628,351 | * | 5/1997 | Ramsey, Jr. et al. | 141/98 |
| 5,634,503 | * | 6/1997 | Musil et al. | 141/232 |
| 5,638,875 | | 6/1997 | Corfitsen | 141/360 |
| 5,868,179 | * | 2/1999 | Harsell, Jr. | 141/94 |
| 5,977,654 | * | 11/1999 | Johnson et al. | 307/10.3 |

FOREIGN PATENT DOCUMENTS

| | | |
|---|---|---|
| WO 93/19004 | 9/1993 | (WO) . |
| WO 94/05592 | 3/1994 | (WO) . |
| WO 94/06031 | 3/1994 | (WO) . |

* cited by examiner

*Primary Examiner*—J. Casimer Jacyna
(74) *Attorney, Agent, or Firm*—McDermott, Will & Emery

(57) ABSTRACT

An automatic refueling station and method detects the arrival of a vehicle to be refueled at the refueling station. Upon detection of the vehicle, the vehicle is polled by the station to obtain information from the vehicle which identifies the vehicle and the customer associated with the vehicle. The information is stored on an identification transponder or tag affixed to the vehicle windshield. The system uses the identifying information to access a vehicle database and a customer database. The vehicle database can provide information about the vehicle such as the location of the vehicle's fuel filler opening, the size of the vehicle and other information related to a recommended fuel filling rate for the vehicle. The customer identifying information is used to access the customer database to obtain information such as customer billing information and the amount of fuel being purchased. Using the data retrieved from the databases, a refueling module can locate the fuel filler opening and refuel the vehicle at a optimum fuel rate. A network of sensors deployed in the refueling area facilitate the refueling procedure. A vision system aides in locating the fuel filler opening and guiding the fuel filler nozzle to the opening. Other sensors such as force, torque, infrared, sonar, magnetic and hall effect sensors aide in guiding the nozzle into a docking position with the vehicle. Other sensors in the area provide monitoring of the area to prevent hazards such as collisions between vehicles and persons and criminal activity in the area.

36 Claims, 15 Drawing Sheets

AUTOMATIC REFUELING STATION

RELATED APPLICATIONS

This application is based on U.S. Provisional Patent Application Ser. No. 60/080,866, filed on Apr. 6, 1998.

FIELD OF THE INVENTION

The invention relates generally to vehicle refueling stations and, more particularly, to automatic refueling stations using robotic mechanisms to refuel a vehicle without intervention by the vehicle operator.

BACKGROUND OF THE INVENTION

The advent of self-serve gasoline stations resulted in lower cost for fuel to consumers. However, it also resulted in a reduced level of safety and convenience to the customer, since the customer is required to exit the vehicle to perform the self-serve refueling procedure. This exposes the customer to inclement weather and the safety risks posed by other moving vehicles in the refueling station and criminal activity in the station.

In response to these issues, several automatic refueling systems have been devised. For example, U.S. Pat. No. 4,881,581 discloses an automatic refueling system for a vehicle. The system can refuel a vehicle from underneath the vehicle and requires that a special fuel tank be installed in the vehicle or that the existing fuel tank be modified.

U.S. Pat. No. 3,642,036 discloses an automatic refueling system with UV-reflective location spots attached to the windshield of the vehicle to locate the vehicle and the fuel filler cap on the vehicle. UV light floods the windshield and sensors detect reflected UV light from the reflected spots as an aide in positioning a fuel filler nozzle close to the fuel fill opening of the vehicle.

U.S. Pat. No. 5,383,500 describes another automatic refueling system which requires the vehicle operator to monitor and control the refueling operation. The vehicle is outfitted with special communications system, controllable by a foot pedal in the vehicle, which is activated by the operator to transmit information to the refueling system. The transferred information includes the position of the fuel fill cap, the fuel type, fuel filler pipe data as well as customer information including bank account data. Hence, the operator is responsible for both controlling the refueling process and for providing the data necessary for both refueling the vehicle and billing for the transaction.

SUMMARY OF THE INVENTION

The present invention is directed to an apparatus and method for automatically refueling a vehicle which overcome the drawbacks of the prior art. The apparatus and method of the invention include a detector which receives information from the vehicle to be refueled and uses the received information to identify the vehicle. The invention then accesses one or more sources of stored vehicle data, such as one or more databases, that contain data related to a plurality of vehicles in order to obtain data related to the identified vehicle. The refueling module of the invention automatically refuels the identified vehicle using the data related to the identified vehicle retrieved from the one or more sources of stored vehicle data.

In one embodiment, the apparatus includes an identifying tag transponder mounted to the vehicle, such as on the windshield of the vehicle, which is readable by the system via RF link. The information related to the vehicle is transferred via the RF link to a receiver coupled to the system.

In one embodiment, the information transferred by the transponder identifies both the vehicle and the operator. The information associated with the vehicle can provide a minimum amount of identifying information such as the make, model and year of the vehicle and the vehicle identification number (VIN). In accordance with the invention, the system then uses this information to access a vehicle database of existing vehicles presently on the road. The information stored in the database for each type of vehicle can include the physical location on the vehicle of the fuel filler opening, critical dimensions of the vehicle, the type of fuel filler cap provided with the vehicle, information related to the fuel filler pipe and maximum fuel filling flow rate. This information can be used to assist the system in optimizing its automatic refueling performance. For example, the fuel filler pipe and maximum fuel filling flow rate information can be used by the system to compute an optimum flow rate to be used during refueling. By refueling at the optimum flow rate, the refueling procedure for each vehicle can be performed more quickly and efficiently, resulting in improved vehicle throughput. Also, the type of fuel filler cap is used to determine a procedure for removing the cap. A robotic gripper can be used by the system of the invention to open the cap. Alternatively, where it is determined that the type of cap is difficult to remove, a special cap as described below, which can include a hinged flap opening and which need not be removed for each refueling procedure, can be supplied to the customer to replace the cap provided by the vehicle manufacturer.

The information provided by the transponder can also include customer or operator information. This information can be used to post the present fuel sale to the customer's account. Accordingly, the information can include a customer's account number, social security number, and/or other required billing information.

In one embodiment, the system of the invention includes a vision system used to detect arrival of a vehicle and also to determine position and orientation of the vehicle in the refueling area. Using this information and the retrieved fuel filler cap location information, the actual location of the fuel filler can be calculated. The vision system can then confirm the actual location of the fuel filler by providing an image of the area around the calculated location of the filler. The vision system of the invention is also adapted to be able to locate and read a license plate on the vehicle and/or perform customer facial recognition. This information can be used to confirm the vehicle and operator identification information retrieved from the windshield transponder. In addition to using the vision system to detect the arrival of a vehicle, a conventional pneumatic tube sensor can be used as a backup.

The system of the invention includes an automatic refueling module which can include a controllable robotic arm. The robotic arm is used to position a fuel filler nozzle, carried by the robotic arm, such that the nozzle docks with the fuel filler opening of the vehicle. After successful docking, the automatic refueling system can be activated to cause fuel to flow through the nozzle into the vehicle. In one embodiment of the invention, the vision system used to detect the position and orientation of the vehicle is also used to control the robotic arm to locate the fuel filler opening of the vehicle. The vision system can include a camera mounted on the robotic arm to provide images of the area near the fuel filler opening as feedback used to control positioning of the arm and nozzle. The robotic arm can first position the nozzle in proximity to the fuel filler door, based on the approximate filler location calculated using the location information retrieved from the database and the actual position and orientation of the vehicle detected by the vision system. The vision system camera on the arm can then provide images to automatically detect the fuel filler and provide feedback to the automatic refueling module to guide the robotic arm such that the nozzle can be docked with the fuel filler opening of the vehicle. If the vehicle includes a hinged fuel filler door, the automatic refueling module of the invention can open the door such as by attaching a suction cup, vacuum gripper and/or a magnet to the door and pulling it open before the docking procedure. If the door is equipped with an interior-controlled latch, the operator can be prompted to unlock the door.

As noted above, in one embodiment, the customer is provided with a special fuel filler cap which replaces the cap provided by the vehicle manufacturer. This special fuel filler cap can be outfitted with a magnetic ring. A magnetic sensor can then be included on the robotic arm to provide location feedback to the refueling module as the robotic arm is guided to dock the nozzle with the fuel filler opening. The magnetic lines of force can guide the nozzle into position. The gas cap can also be equipped with highly visible marking to assist the vision system in locating the gas cap.

Several different types of sensors can be used in connection with and/or mounted on the robotic arm to aid in positioning the robotic arm to dock the nozzle with the fuel filler opening. These sensors, in addition to the wrist-mounted camera of the vision system, can include a ranging infrared sensor used to provide distance feedback during positioning. A sonar sensor can also be mounted to the robotic arm to determine distance from the nozzle to the fuel filler opening. Force and/or torque sensors can be used to provide force and torque feedback during docking of the nozzle to guide the nozzle into the fuel filler opening throat. A sensor such as a hall effect sensor can be used to confirm successful docking.

In addition to the sensors on the refueling module, other detectors and sensors can be included in the refueling area to facilitate the overall refueling procedure. For example, a sonar system and/or infrared array can be used to determine the position and orientation of the vehicle as a back-up or confirmation of the data obtained by the vision system. They can also be used to detect motion of the vehicle during refueling. The arm can also detect motion. This motion sensing can be used to interrupt the refueling process and quickly decouple from the vehicle in the event that the operator moves the vehicle while it is being refueled. Under these conditions, disconnecting the fuel supply from the nozzle can eliminate a very serious hazard threat.

The system can also include an audio sensor and/or a vibration sensor for detecting whether the engine in the vehicle being refueled is running. This facility provides an interlock function which prevents the refueling process form proceeding if the engine is running. Also, if the engine is started after the refueling process begins, the refueling process can be terminated safely until the engine is turned off. A variety of additional sensors can monitor the region in which the vehicle is being refueled to provide operator safety and security. For example, smoke, temperature, and infrared sensors can be used to detect fire in the region near the refueling station. Also, a surveillance system including vision system cameras and microphones can be used to monitor and prevent vandalism and/or other criminal activity in a refueling station. The surveillance or vision system can also be used to detect persons or moving vehicles in the refueling area. The system can alert operators and other persons of possible collisions in the station.

Thus, the automatic refueling station of the invention is completely automatic in that it requires no operator intervention. The automatic sensors in the refueling station initiate and monitor the refueling process very quickly and efficiently. Additional sensing and monitoring capability provides a safe and secure environment for the refueling procedure and transaction. The information required to be carried and provided by the user, i.e., in the windshield identification tag, is kept to a minimum to improve the efficiency of the procedure by minimizing data and transfer errors. The information in the transponder virtually never needs update since all that it provides is identification information. The substance of information used to perform the refueling procedure and record and bill for the transaction is maintained in a separate system database, which can be remote from the refueling station. Therefore any information, updates or changes can be performed in the database and can be transparent to the operator/user.

All of these features combine to create a refueling system and station which provide extremely high vehicle throughput. In most cases, the time required to refuel a vehicle is below one minute. With such low process time and resulting high throughput, waiting lines are minimized or eliminated. As a result, the size of the station can be reduced because there is no need to accommodate a line of cars. Additionally, traffic which may be caused by long lines is eliminated.

The invention also provides other improvements over prior stations by requiring no operator intervention. As a car pulls into the station, its presence or motion are sensed automatically by the vision system or the web of additional sensors including infrared, sonar, etc. Once the motion is detected, the RF communication system is implemented to poll the windshield identification tag for the required vehicle and operator identification information. In most cases, this information will be obtained and transferred to the refueling system before the vehicle even comes to rest within the station. Refueling can then begin almost immediately. This is not the case in prior systems which require operator intervention. In these prior systems, the operator must typically bring his vehicle to a halt at the refueling area and then activate the refueling mechanism, for example, by inserting a card or by operating a foot pedal to activate a communication system. The delays in prior systems result in a much slower refueling procedure and, therefore, much lower overall station throughput than is provided by the system of the present invention.

The automatic refueling station of the invention, because of its wide array of sensing capabilities and its complete automation, can provide all of the services found in manned "full-serve" stations. The sensing and robotic capabilities can provide any number of vehicle maintenance capabilities. For example, sensors can be adapted to check vehicle fluid levels, such as oil, coolant, transmission fluid and windshield washer fluid. Where a fluid level is detected as being low, the robotic system of the station can be activated to fill the appropriate fluid reservoir. Other maintenance items such as tire pressure and tread levels can be checked and a warning can be transmitted to the operator as required.

As all of these full serve procedures are performed, the expert supervisory system of the invention operates to optimize the station efficiency and therefore improve overall vehicle throughput. From the moment the vehicle enters the station, it is detected and identified. Using information acquired by the system, the vehicle determines where and how the vehicle and customer can be served more efficiently. Information associated with the vehicle and customer stored in the databases are used by the system to optimize efficiency of the process and convenience to the customer. For example, a particular customer may wish to have his oil level checked each time he enters the station. That information is retrieved from the customer database. The system then directs the customer to the area that can most efficiently perform the refueling procedure and check the oil level. As the procedures are performed, the system monitors progress and may interact with the customer to provide additional services. For example, convenience stores items can be purchased by and automatically delivered to the customer, or the customer can be provided with personal reminders, for example, that his dry cleaning is ready to be picked up.

Hence, the system of the invention, by monitoring and controlling the entire interaction with the customer, beginning when the customer first enters the station and ending as he drives out, provides an extremely efficient and convenient transaction. The automatic sensing capabilities of the system, as well as its automated robotic service providing capabilities, provide a safe, reliable and efficient purchasing experience.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1A:
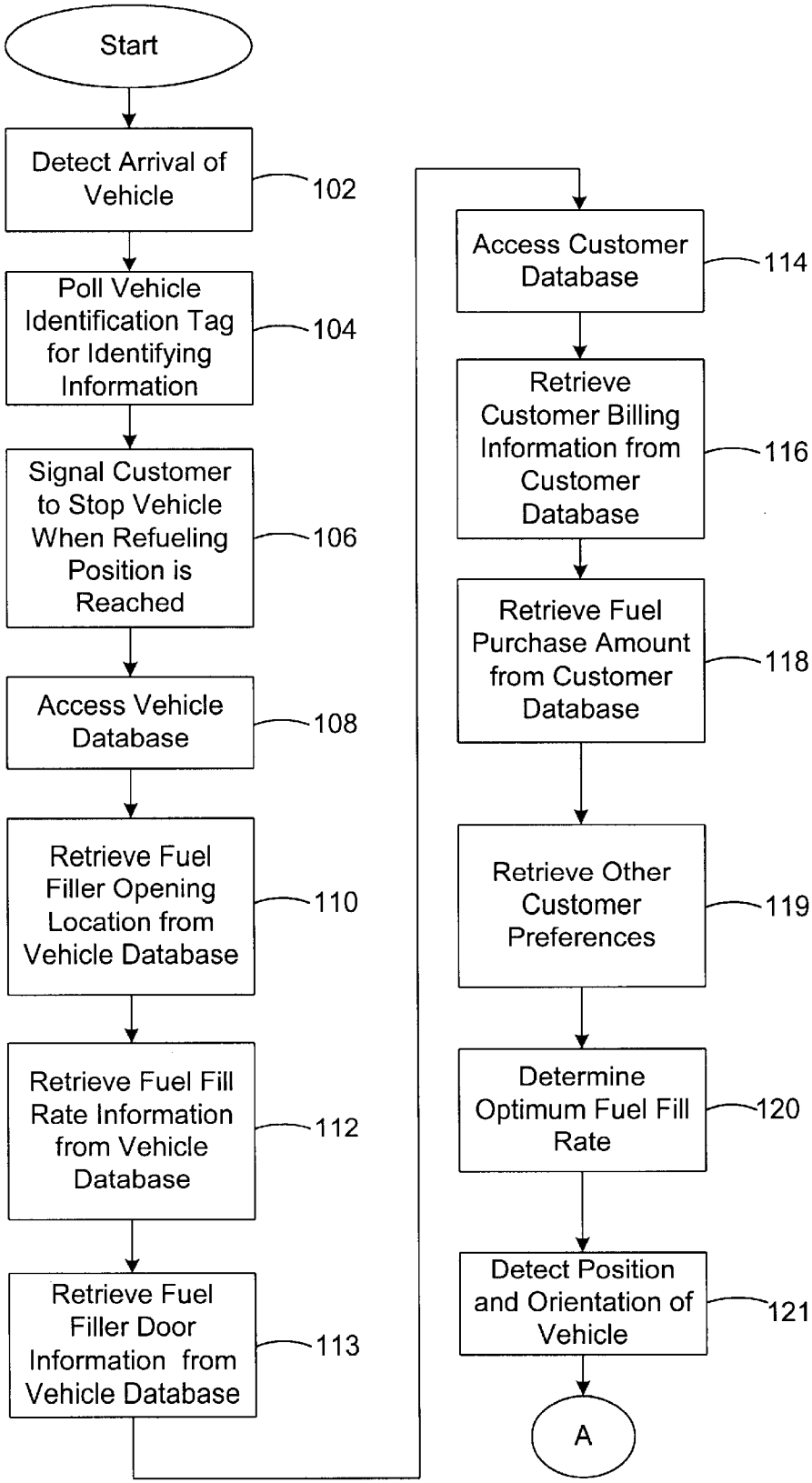
FIGS. 1A–1C contain a flow diagram illustrating the logic flow one embodiment of the automatic refueling method in accordance with the present invention.
Figure 1B:
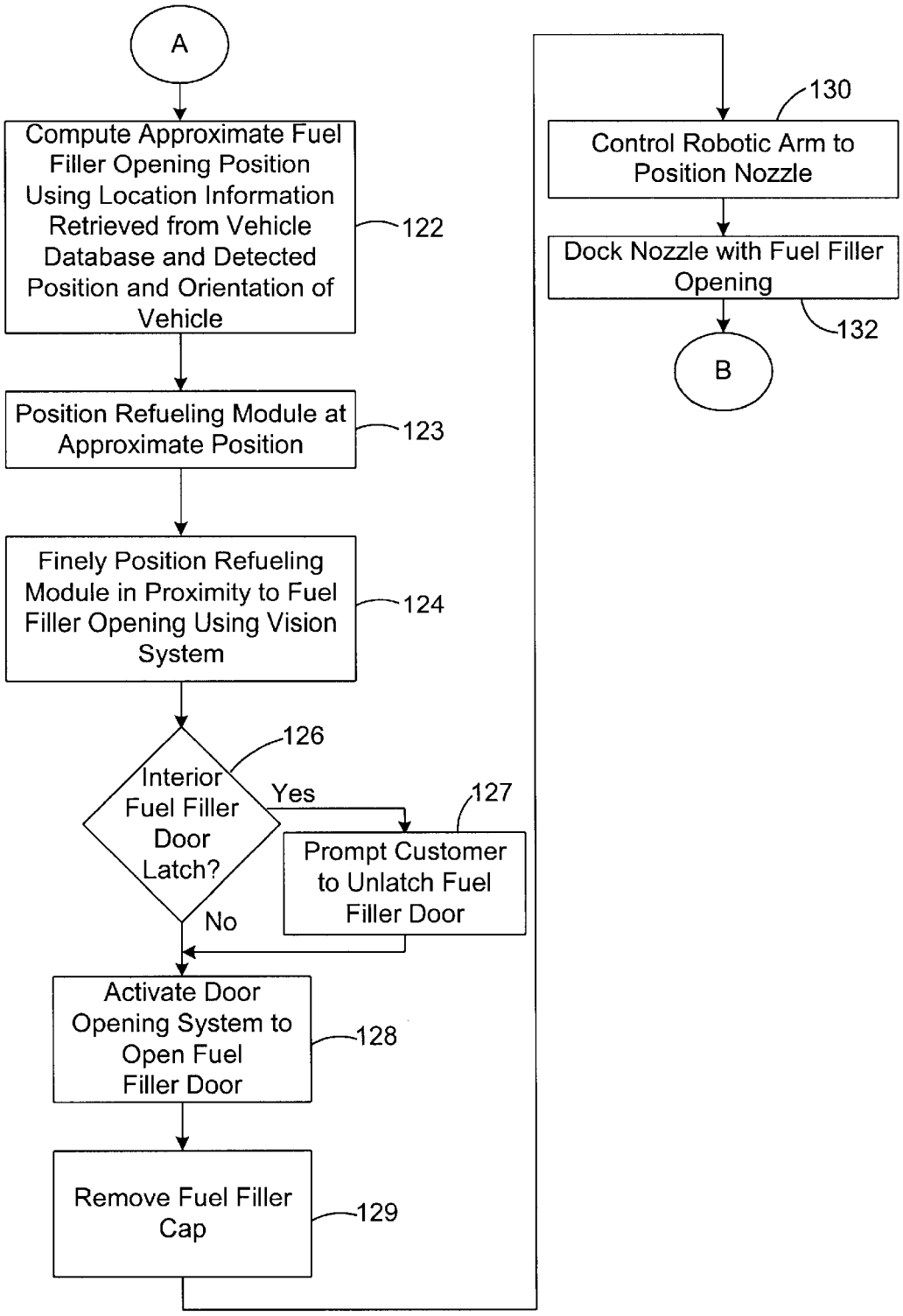
Figure 1C:
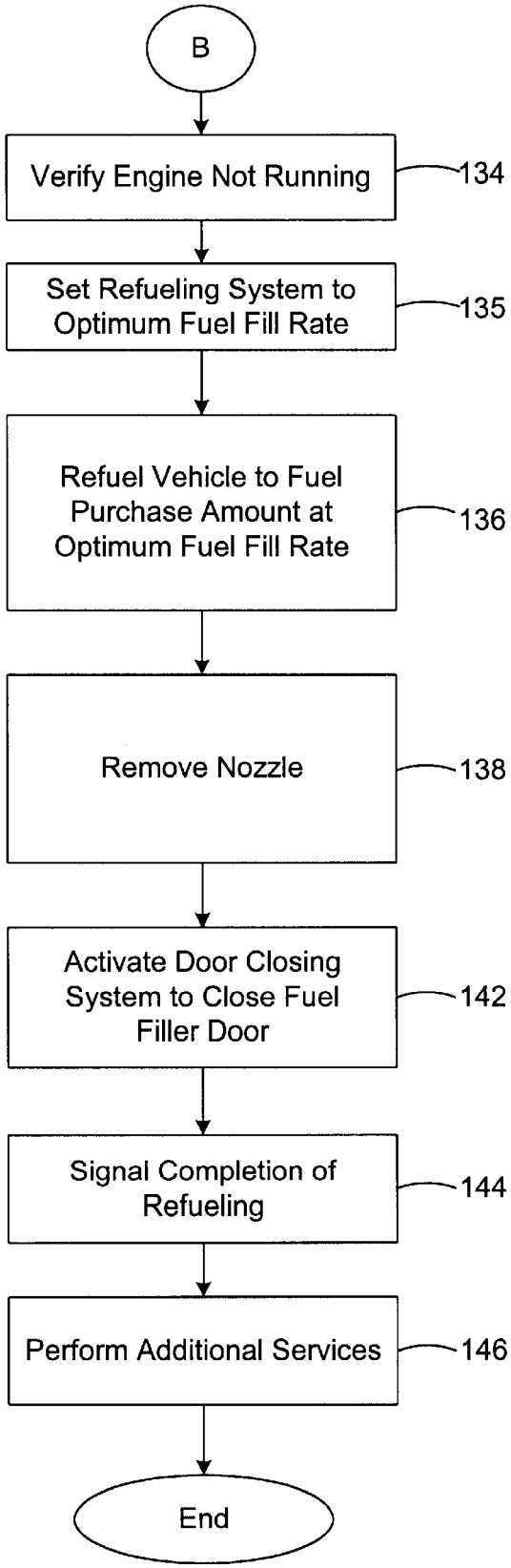

FIGS. 1A–1C contain a flow diagram which illustrates the logical flow of one embodiment of the automatic refueling system and method of the invention. As indicated by step 102, the refueling process begins when system sensors detect the arrival of a vehicle in the refueling station. This can be accomplished by one or more infrared sensors, sonar sensors or the vision system or any combination of the various types of sensors implemented in the station.

When a vehicle is detected, the operator is directed audibly or by signs to position his car at the fastest available refueling area for that vehicle. Factors such as maximum fueling rate of the vehicle, the status of vehicles already in the station, the number of gallons required and any additional required services are considered in determining which refueling area will be the fastest. When the system detects proper position of the vehicle, the operator/customer is signaled to stop the vehicle at the refueling position in step 106.

After the arrival of the vehicle is detected, the vehicle is polled for identifying information in step 104. In one embodiment, the identifying information is stored on an identification tag or transponder mounted on the vehicle windshield. An RF communication system polls the identification tag which returns the required information.

In one embodiment, the retrieved information contains identifying information which identifies the vehicle and the customer associated with the vehicle. The vehicle can be identified by its year, make and model and/or vehicle identification number, and the customer can be identified by a preassigned customer account number. This information is encoded on the identification tag which is issued to the customer when the account is first set up. In step 108, the vehicle information is used to access one or more sources of stored vehicle information, collectively referred to herein as a "vehicle database," which includes data for each year, make and model of vehicle presently on the road. The data include information such as the location of the fuel filler opening on the vehicle, the fuel filler pipe dimensions and other related fuel fill rate information, critical dimensions of the vehicle and information as to whether the vehicle has a hinged fuel filler door which needs to be opened and closed during the refueling process and whether the door has an interior-controlled latch. In step 110, the location of the fuel filler opening is retrieved from the vehicle database; in step 112, fuel fill rate information is retrieved; and in step 113, the fuel filler door information is retrieved.

In step 114, the customer identification information is used to access one or more sources of stored customer information, collectively referred to herein as a "customer database." The customer database includes such information as billing address and other billing information and also other optional information customized to the customer's transaction preferences, such as an amount of fuel to be purchased by the customer during each visit to the station, e.g., full tank, specific number of gallons or purchase price, or an octane level selection. The customer information can also include other optional services to be performed during a visit, such as fluid level checks. Also, other transaction preferences can be provided with the customer information such as automatic purchases of convenience items, e.g., coffee, newspaper, or personal reminders, e.g., dry cleaning. In step 116, the customer billing information is retrieved form the database; in step 118, the fuel purchase amount is retrieved from the database; and in step 119, other customer preferences are retrieved.

Both the vehicle database and customer database can be updated to adapt to changes in the vehicle and/or customer information. For example, if the condition of the fuel filler area on the vehicle is changed, such as by damage, the system can automatically update stored fuel filler location data if necessary.

In step 120, the system uses the fuel fill rate information retrieved from the vehicle database in step 112 to determine an optimum fuel fill rate for the vehicle. By computing an optimum fuel fill rate, the system of the invention can fill most cars more quickly than conventional stations which typically have fuel fill rates set as low as possible to accommodate all vehicles. Since most vehicles can accept much higher fuel fill rates, this feature of the invention provides a much more efficient fuel fill procedure than is found in conventional automatic fueling systems.

The station of the invention includes a robotic arm which positions the fuel fill nozzle in the fuel fill opening of the vehicle. The robotic arm is mounted to a refueling module which can be mounted on an overhead gantry or side mounted gantry. Alternatively, the robotic arm can be mounted on a mobile cart which positions itself as required in the refueling area. In step 121, the vision system and/or other sensors are used to detect the actual position and orientation of the vehicle being refueled. In step 122, this information and the fuel filler opening location information retrieved from the vehicle database are used to determine an approximate fuel filler opening location. In step 123, the refueling module locates the robotic arm in proximity to the approximate fuel filler opening position. Next, in step 124, the vision system of the invention is activated to perform fine positioning of the refueling module and robotic arm.

The refueling module of the invention also includes the capability of opening a fuel filler door on the vehicle. Where the vehicle information retrieved from the vehicle database indicates that the vehicle has an interior-controlled fuel filler door latch (step 126), the system can prompt the customer to unlatch the fuel filler door in step 127. In step 128, a door opening subsystem of the refueling module is used to open the fuel filler door. This subsystem can include a suction cup, vacuum gripper and/or magnet which is temporarily attached to the fuel fill door and is pulled back to open the door. After the door is opened, a robotic gripper, which can be part of the refueling module, is activated to remove the fuel filler cap in step 129.

In step 130, the robotic arm is activated to position the nozzle in the fuel filler opening of the vehicle. In steps 130 and 132, the robotic arm is controlled to position and dock the nozzle with the fuel filler opening. In one embodiment, docking is performed to achieve a tight seal such that Stage II vapor recovery regulations are satisfied.

To accomplish the positioning and docking procedures, the robotic arm can be outfitted with a variety of sensors. In one embodiment, a wrist-mounted camera mounted to the wrist of the robotic arm is used to provide visual imagery feedback for the vision system of the invention used to locate the robotic arm. Additionally, the robotic arm can include a magnetic sensor for detecting magnetic field produced by a magnetic ring attached to the specially-produced gas cap attached to the vehicle. A force feedback sensor and a torque feedback sensor can also provide force and torque sensing functions. Infrared and sonar sensors can be used for detecting distance between the nozzle and the fuel filler opening. A hall effect sensor can be used to detect when docking is achieved.

After docking is achieved, in step 134, a motion sensor or acoustic sensor is used to verify that the engine is not running. In step 135, the refueling module is set to an optimum fuel fill rate determined in step 120. In one embodiment a very fast fuel fill rate, e.g., more than twenty gallons per minute, can be achieved. In step 136, the vehicle is refueled to the fuel purchase amount retrieved from the customer database in step 118 at the computed optimum fuel fill rate. When the refueling procedure is complete, the nozzle is removed from the fuel fill opening in step 138. In step 142, a door closing subsystem is activated to close the door. In step 144, the system signals to the operator of the vehicle that the refueling procedure is complete. In step 146, any required additional services can be performed.

Figure 2:
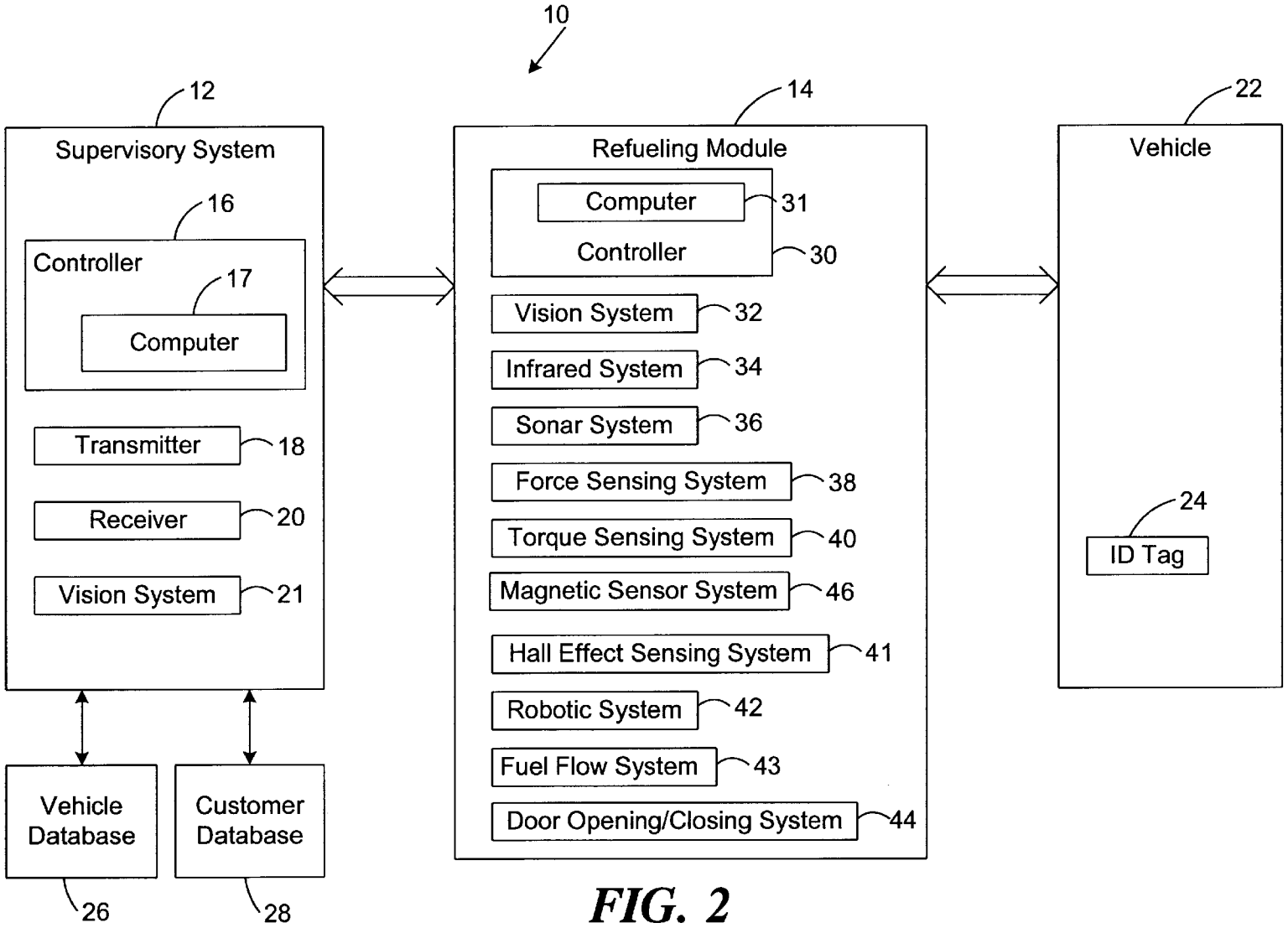
FIG. 2 contains a schematic block diagram of one embodiment of an automatic refueling station in accordance with the present invention.

FIG. 2 is a schematic block diagram of the system 10 of the invention for automatically refueling a vehicle 22. The system 10 includes a supervisory system 12, including a controller 16 with a computer 17, which monitors and controls the refueling procedure and the overall operation of the refueling station. A refueling module 14, which is commanded and monitored by the supervisory system 12, performs the actual refueling procedure on the vehicle 22. The vision system 21 is used to detect the arrival of the vehicle 22 and report the arrival to the controller 16 and/or computer 17. A transmitter 18 is commanded to transmit the RF polling signal to the ID tag or transponder 24 affixed to the vehicle 22. The receiver 20 of the system 12 receives the data returned from the ID tag 24. The controller 16 uses the returned vehicle information to access the vehicle database 26 and uses the returned customer information to access the customer database 28. The transponder 24 can also include an active transmitter used to provide communication from the customer to the system 12. The transponder 24 can include a keypad used by the customer to provide a limited set of commands, such as a change in fuel amount or octane level or a request for an additional service, such as a purchase of a convenience item or a service check. The transponder 24 can also provide the customer with the ability to abort the refueling process.

The vision system 21, in addition to detecting the presence of the vehicle 22, also monitors the refueling area to detect multiple hazards. For example, the vision system 21 can be used to detect a person walking in the refueling area. This can be dangerous since collisions between persons and the robotic equipment and/or vehicles can occur. Also, the vision system 21 can be used to detect other moving vehicles in the area and also to monitor the area as a safeguard against criminal activity such as vandalism and other crimes perpetrated against customers and/or their vehicles.

The refueling module 14 is controlled by the supervisory system 12 to refuel the vehicle 22. The refueling module 14 includes a robotic system 42 which controls positioning of the fuel filler nozzle to dock the nozzle with the fuel filler opening of the vehicle. The robotic system 42 can include a robotic arm which carries the nozzle under the control of the module 14 to dock the nozzle with the vehicle 22. The refueling module 14 can be a self-propelled mobile module which can move around the refueling area under its own power tethered to the supervisory system 12. Alternatively, the robotic system 42 can include a gantry to which the robotic arm is mounted.

A door opening/closing system 44 is used to open and close the vehicle fuel filler door. The door opening/closing system 44 can be included as part of the robotic system 42 or it can be its own separate system, also controlled by the controller 30.

The refueling module 14 includes various subsystems used to assist in positioning and docking the fuel filling nozzle. Each of these subsystems operates under the control of the controller 30 which includes a computer 31 and which is controlled by the supervisory system controller 16. A vision system 32 is also included in the refueling module 14 to provide visual imagery to assist in the docking procedure. The vision system 32 can include a camera which is mounted on the wrist of the robotic arm in the robotic system 42. It should be noted that the vision system 32 can be a separate system from the vision system 21. Alternatively, one overall vision system can be used and can receive imagery input from multiple cameras, some of which can be mounted in the refueling area to detect the arrival or presence of vehicles and persons. Another camera of this overall vision system can be mounted to the wrist of the robotic arm in the refueling module 14.

The refueling module 14 can also include several other types of sensing systems used to position the robotic arm to dock the nozzle. For example, an infrared system 34 and/or a sonar system 36 can be included to provide range information such that the distance between the nozzle and the vehicle can be monitored in real time. A force sensing system 38 can provide force feedback from the robotic arm and/or nozzle, and a torque sensing system 40 can provide torque feedback. A hall effect sensor system 41 can also be included on the robotic arm to detect contact between the nozzle and the fuel filler opening to confirm docking of the nozzle. Each of these sensing systems provides feedback used by the controller 30 and robotic system 42 and door opening/closing system 44 to perform the required positioning, door opening/closing and refueling tasks required.

A magnetic sensor system 46 can also be included on the robotic arm. The magnetic sensor can operate in conjunction with a magnetic ring which is attached to a special fuel filler cap (see FIG. 9) attached to the vehicle's fuel filler pipe. This special cap is provided to the customer when the customer sets up an account with the provider. This special cap also includes a flap opening providing access to the fuel filler pipe for the nozzle. As the nozzle docks with the fuel filler opening, the nozzle forces the flap aside to permit refueling. This eliminates the need to remove the cap provided with the vehicle by the manufacturer of the vehicle.

Figure 2A:
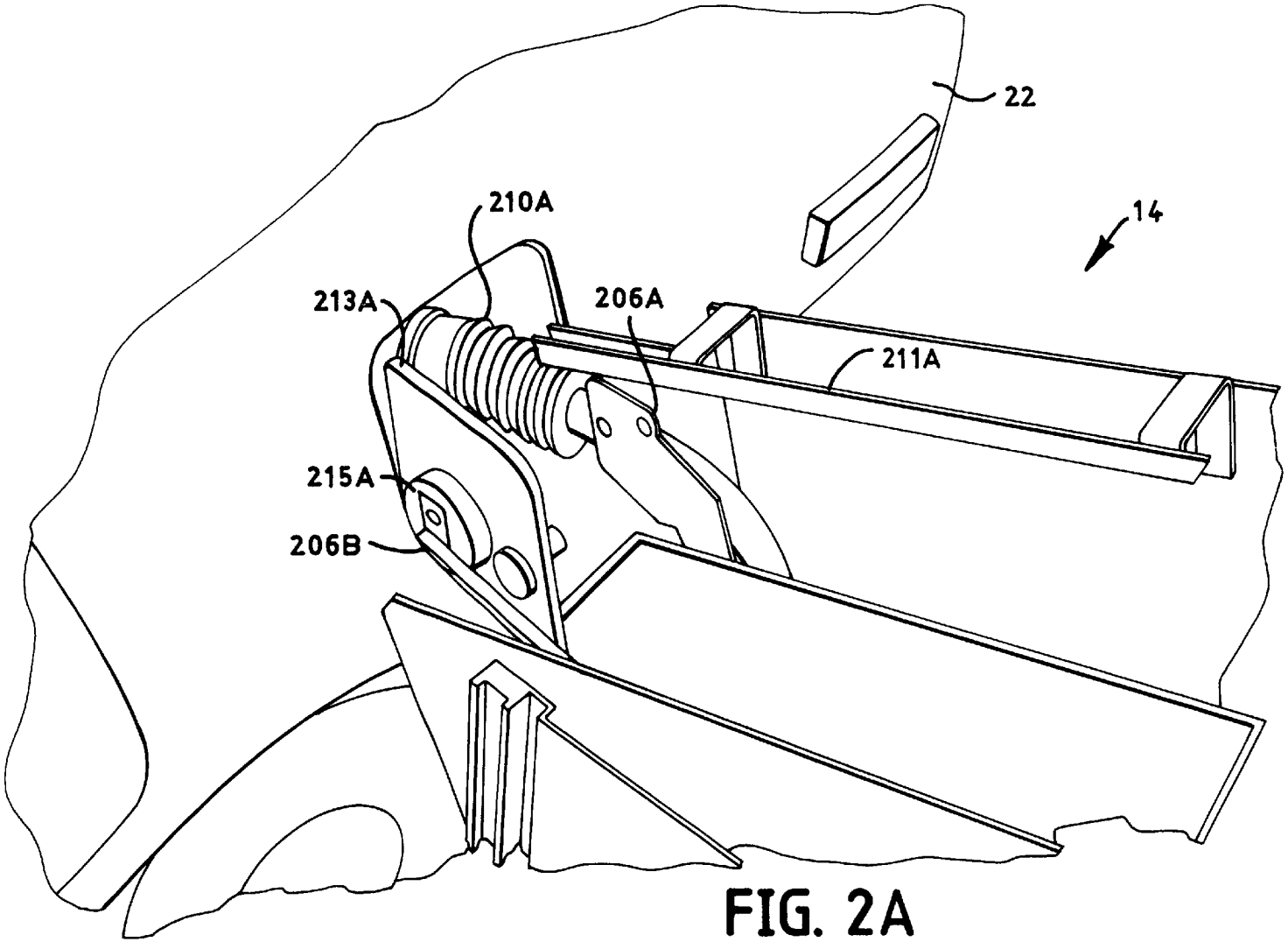
FIG. 2A contains a pictorial view of a portion of one embodiment of an automatic refueling module in accordance with the present invention.

FIG. 2A contains a pictorial view of a portion of one embodiment of robotic refueling module 14 coupled to a vehicle 22 for refueling the vehicle 22 in accordance with the invention. In this embodiment, the robotic refueling module 14 includes dual robotic end effectors. One end effector includes the controllable refueling robotic arm 206A which moves along a slide 211A to dock the refueling nozzle 210A with the fuel filler opening of the vehicle. A flexible refueling hose can be fed into the vehicle fuel tank to bypass constrictions, thereby increasing the refueling rate. A second controllable end effector includes another robotic arm 206B which is part of the door opening/closing system 44. The arm 206B is shown attached to the hinged fuel filler door 213A of the vehicle 22 by a magnet 215A.

Figure 3:
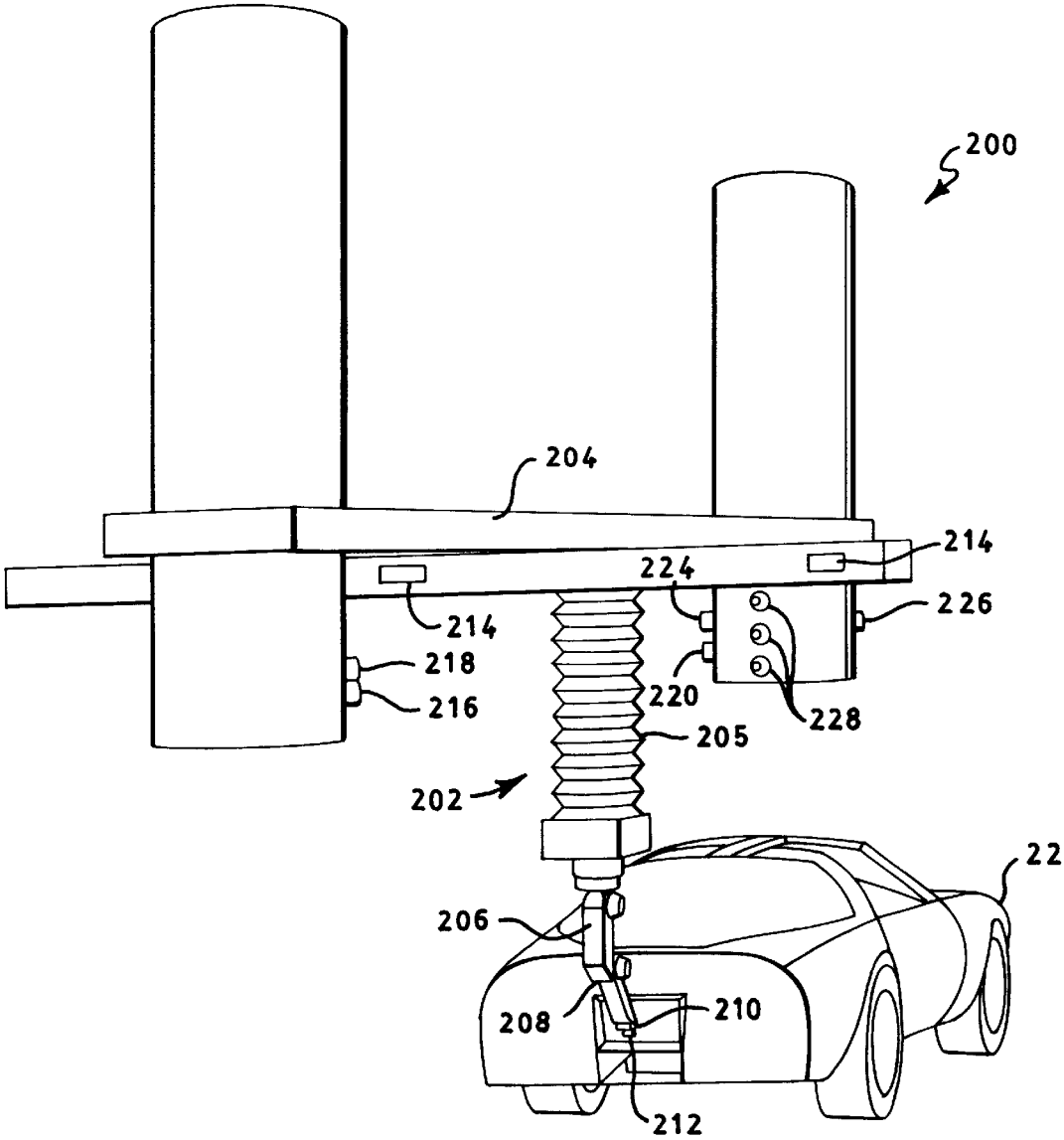
FIG. 3 contains a schematic pictorial view of one embodiment of an automatic refueling station in accordance with the present invention.

FIG. 3 contains a schematic pictorial view of one embodiment of an automatic refueling station 200 in accordance with the present invention. The refueling station 200 includes an automatic refueling module 202 suspended by a control arm 205 from an overhead gantry system 204. The vehicle 22 being refueled is positioned under the gantry 204 for refueling. The refueling module 202 includes a controllable robotic arm 206 having a wrist 208 and coupled to a refueling nozzle 210. As shown, the refueling nozzle 210 is docked with the refueling opening 212 of the vehicle 22. The station 200 is preferably outfitted with one or more cameras 214 which provide visual images of the area where the vehicle 22 is being refueled.

As described above, the refueling area can also be outfitted with various additional sensors which are shown mounted to the overhead gantry 204. These various sensors are indicated generically in FIG. 3 mounted to the overhead gantry system 204. The sensors can include an infrared sensor 216, a sonar sensor 218, an audio sensor or microphone 220, a thermal sensor 224, and a vibration sensor 226. In addition, indicator lights 228 can be mounted on the overhead gantry system 204 to signal various conditions to the operator. For example, one of the lights can be used to instruct the user to stop his vehicle at the refueling location. Another of the lights can indicate when the refueling process has begun. Another one of the indicators can indicate when the refueling process has been completed. It will be understood that the types, positions and numbers of sensors shown in FIG. 3 are meant as an illustration only and are not intended to limit the invention to a particular sensor configuration. Any combination of any of the sensors can be used in accordance with the invention. Additionally, the positions of the sensors can be changed according to a particular desired configuration.

Figure 4:
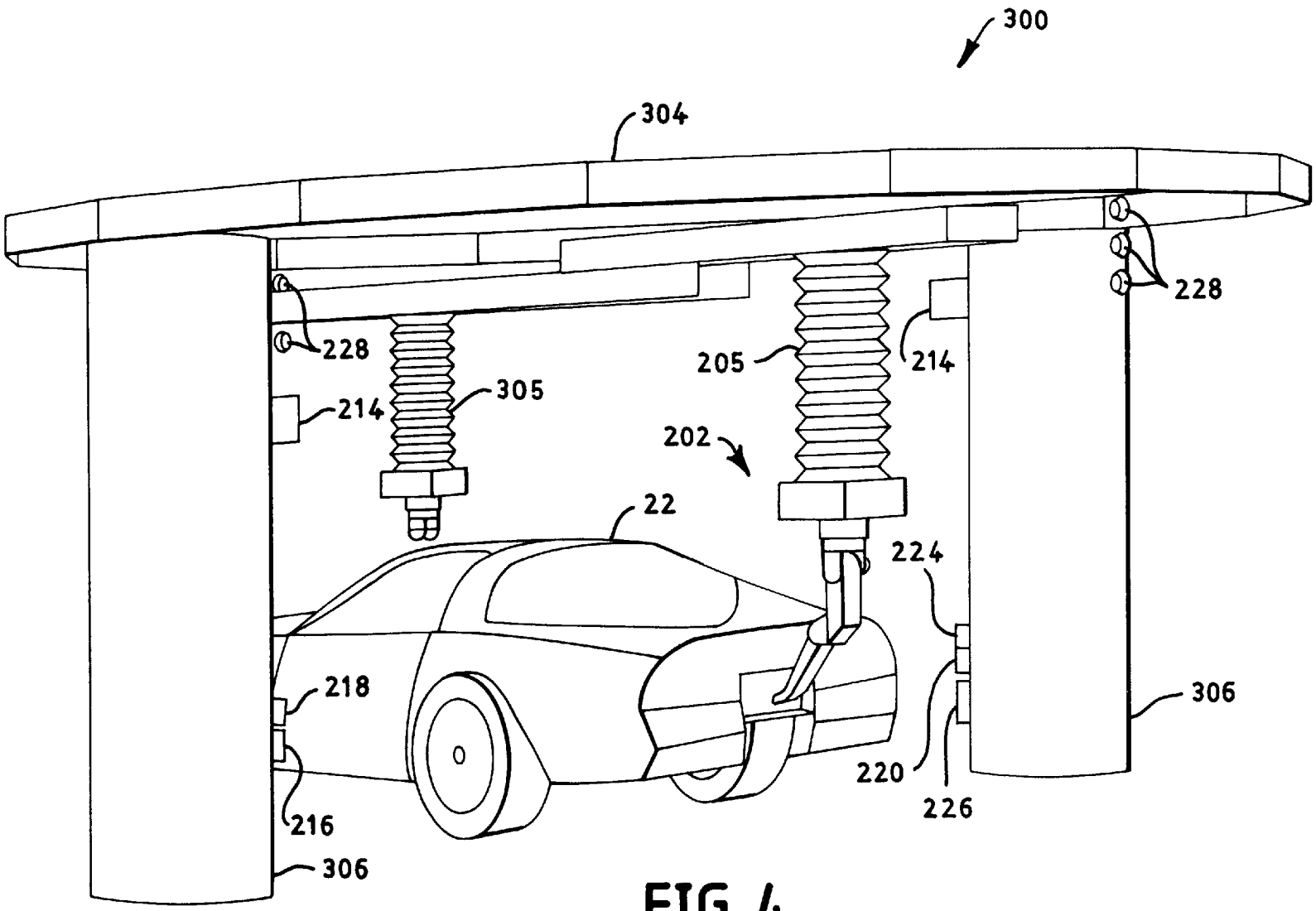
FIG. 4 contains a schematic pictorial view of an alternative embodiment of automatic refueling station in accordance with the present invention in which multiple robotic arms can be used to perform multiple tasks.

FIG. 4 is a schematic pictorial illustration of another embodiment of a refueling station 300 in accordance with the invention. In this embodiment, the overhead gantry system 304 is supported from the floor of the station by multiple supports 306 rather than from the ceiling. In this case, the multiple sensors 216, 218, 220, 224 and 226 as well as cameras 214 and indicator lights 228 can be mounted to the supports 306. In this embodiment, an additional control arm 305 is provided to initiate services other than refueling. For example, the control arm 305 can be outfitted with a robotic arm which will wash the windshield of the vehicle 22.

Figure 5:
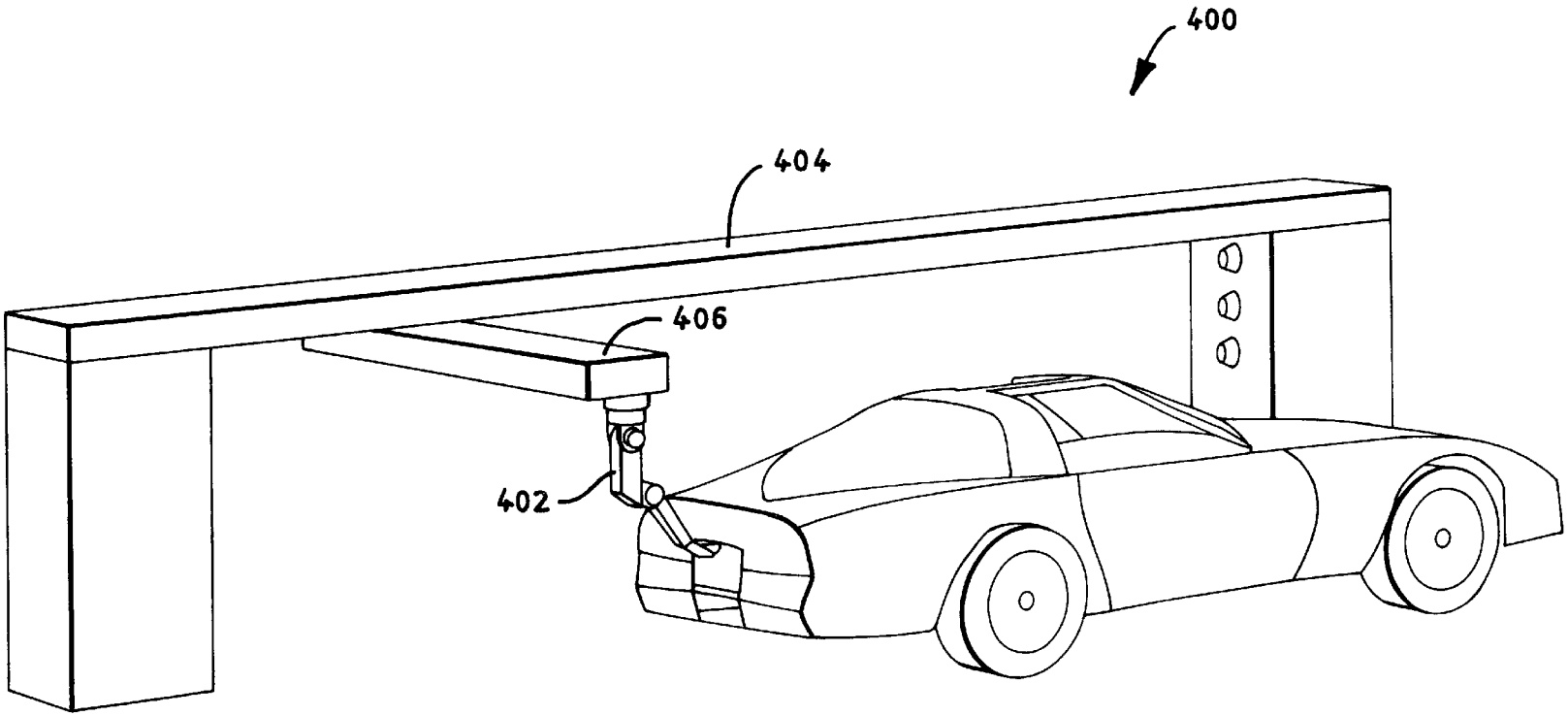
FIG. 5 contains a schematic pictorial view of another alternative embodiment of an automatic refueling station in accordance with the present invention in which a side gantry is used to support the refueling module.

FIG. 5 contains a schematic pictorial view of another alternative embodiment of a automatic refueling station 400 in accordance with the invention. In this embodiment, the refueling module 402 is supported by a side gantry 404 and a controllable pivot arm 406. As shown in the previously described embodiments, this alternative embodiment 400 also includes the network of sensors and cameras used to implement and control the refueling process.

Figure 6:
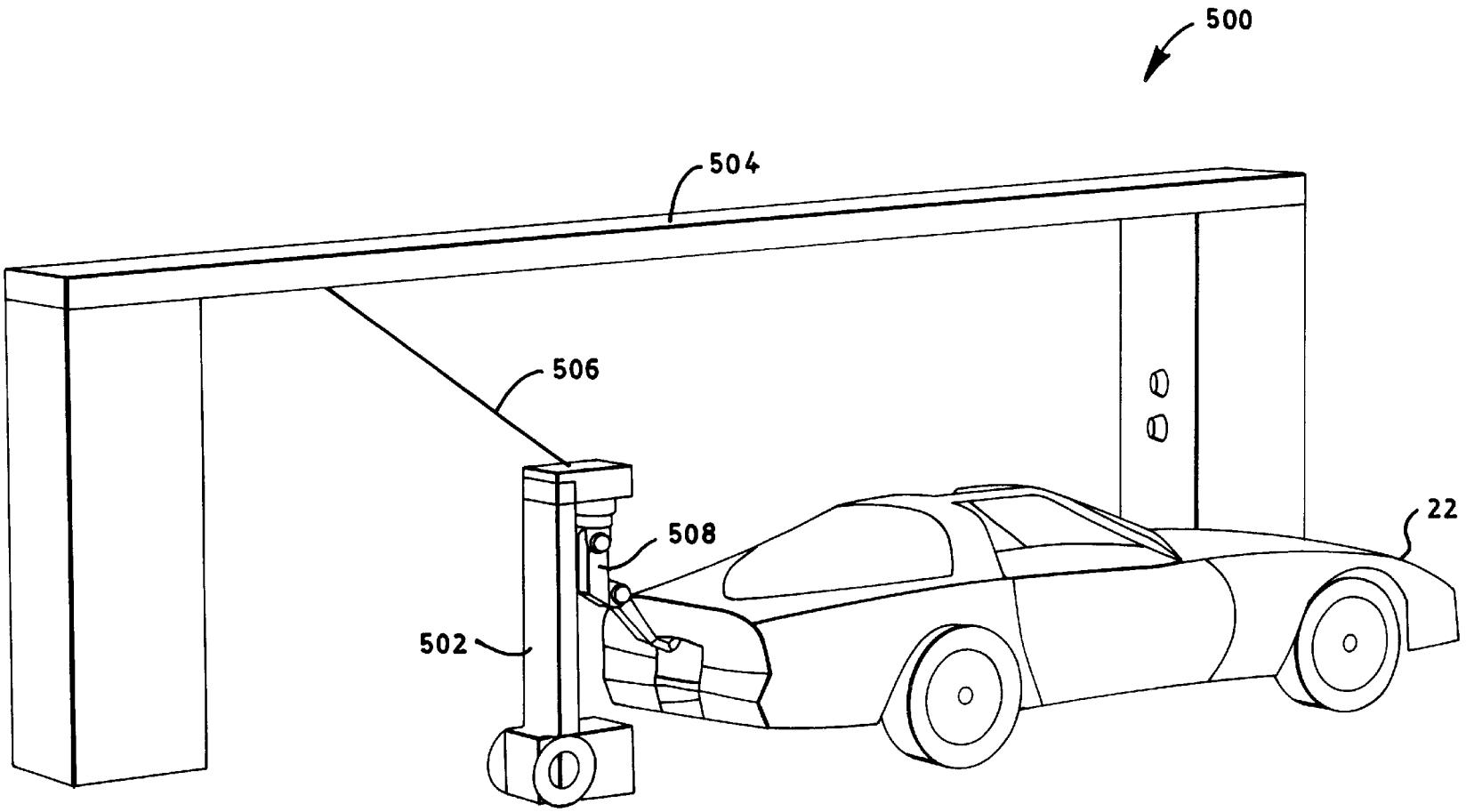
FIG. 6 contains a schematic pictorial view of another alternative embodiment of an automatic refueling station in accordance with the present invention in which a mobile refueling module is implemented.

FIG. 6 is schematic pictorial view of another alternative embodiment of an automatic refueling station 500 in accordance with the invention. In this embodiment, a mobile self-propelled refueling module 502 can position itself in the refueling area in proximity to the vehicle 22 being refueled. The refueling module 502 controls the robotic arm 508 to position the nozzle to refuel the vehicle 22. In one embodiment, the refueling module 502 is connected to the station 500 by a tether 506. The tether carries fuel along a hose to the refueling module 502. It also carries electrical wiring for control signals from the station 500. The tether can be mounted on a side overhead gantry 504.

The mobile module 14 can also be an untethered module which can maneuver between multiple pumps to refuel multiple vehicles simultaneously. In this configuration, the module 14 can be used to retrofit existing conventional refueling stations.

Figure 7:
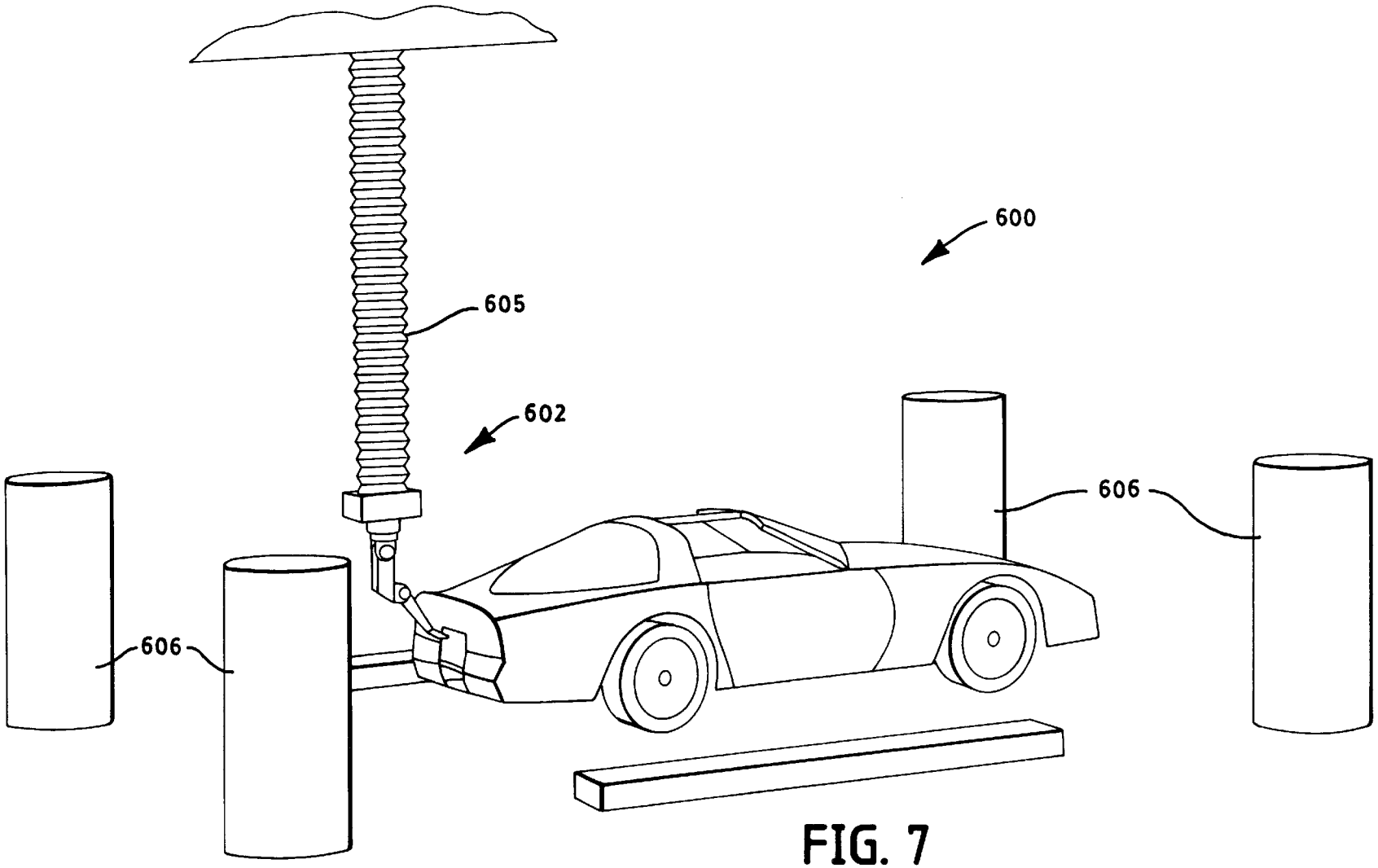
FIG. 7 contains a schematic pictorial view of another alternative embodiment of an automatic refueling station in accordance with the present invention in which a conventional fueling station is retrofitted with automatic refueling equipment.

FIG. 7 is a schematic pictorial view of another embodiment of an automatic refueling station 600 in accordance with the invention. In this embodiment, an existing refueling station is retrofitted with equipment to implement the automatic refueling procedure. In this embodiment, the refueling module 602 includes a refueling control arm 605 mounted to the ceiling of the existing station 600. In addition, posts 606 are installed to mark off the refueling area. The network of sensors used in accordance with the invention can be attached to the posts 606.

Figure 8:
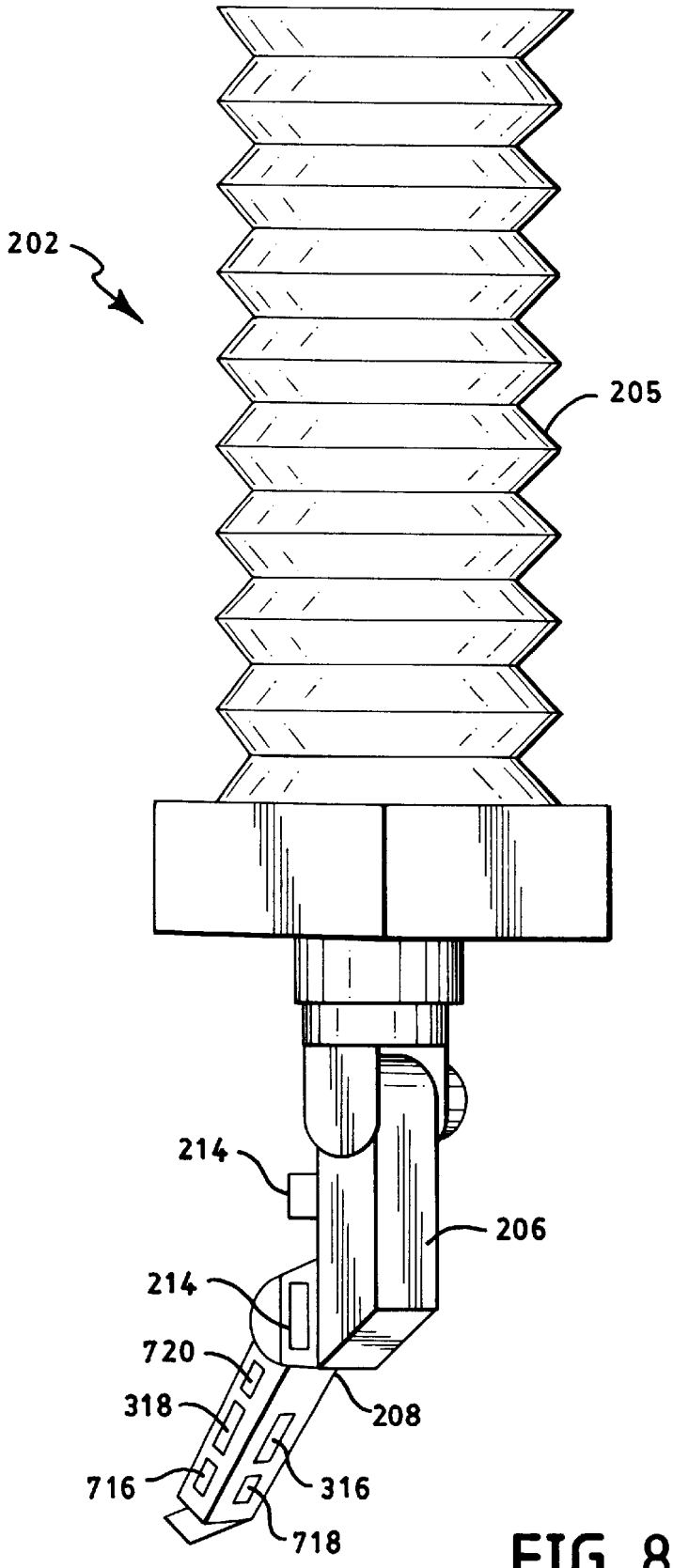
FIG. 8 contains a schematic pictorial view of one embodiment of a refueling arm which can be used with the automatic refueling station of the present invention.

FIG. 8 is a schematic detailed diagram of a control arm 205 and robotic arm 206 in accordance with the invention. The robotic arm 206 includes a wrist 208 on which can be mounted a camera 214 which can provide visual imagery data to the vision system of the invention which can be used to position the robotic arm 206 as required. The arm 206 can also be equipped with various additional sensors used in positioning the arm. For example, a torque sensor 316 can provide torque feedback and a force sensor 318 can provide force feedback. Also, an infrared ranging sensor 716 can be used to determine distance to the vehicle filler opening. A sonar sensor 718 can also be used to provide ranging information. Also, a magnetic sensor 720 can be implemented to detect the magnet mounted to the special fuel cap mounted to the vehicle (see FIG. 9).

Figure 9:
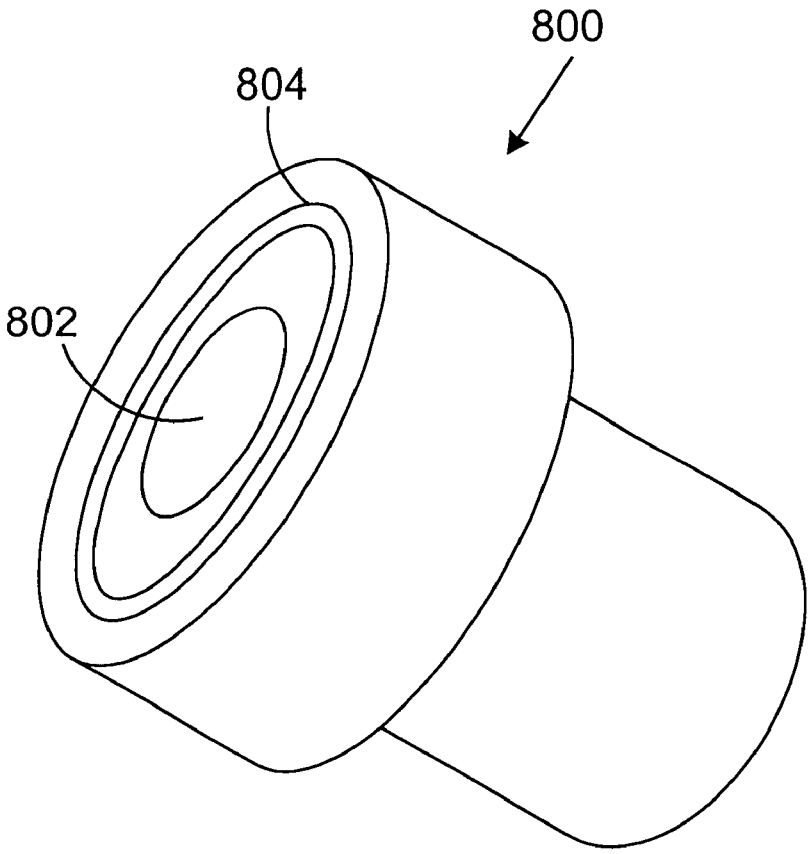
FIG. 9 contains a schematic pictorial view of a special gas cap used in one embodiment of the automatic refueling station of the present invention.

FIG. 9 is a schematic pictorial view of one embodiment of a special fuel filler cap 800 mounted on the vehicle in accordance with the invention. The fuel cap 800 is designed such that it fits the top of a standard fuel filler pipe in most vehicles. The cap replaces the standard cap provided with the vehicle and need not be removed when the refueling procedure of the invention is implemented. The cap is equipped with a spring-loaded flap 802 which is forced out of the way by the nozzle when the nozzle is docked with the fuel cap. The cap 800 can also be equipped with a ring magnet 804 which can be sensed during docking by the magnetic sensor 720 mounted on the robotic arm 206.

One embodiment of an automatic robotic vision system which can be used in accordance with the present invention will now be described in detail. It will be understood that the vision system is applicable to many settings other than the refueling station of the invention. In general, it can be used in any video surveillance setting and is described accordingly.

In one embodiment, the vision system is composed of robotic camera modules 214 which can automatically detect and track changes in the environment being monitored, e.g., the refueling station. These robotic cameras can in turn communicate over a data network to each other, other command and control stations, and archival storage stations. A human operator can also assert manual control over a robotic camera through an innovative teleoperation interface over the network. Multiple cameras can be manually or automatically coordinated to provide different views of a surveillance subject. The system can also automatically switch to the camera offering the best view of an intruder, thereby following the intruder throughout the station.

The operator can also direct the robotic camera to focus on an individual in a crowd. The system can then center its search area on the subject and match the search area with motion of the subject. Pattern matching and motion analysis algorithms are applied to help discriminate the subject from the other people. The system is more sensitive to motion and can track a subject faster than a human operator.

The robotic camera module is composed of a motorized pan/tilt base, tracking sensor, control computer and network interface. The pan/tilt unit is unique in that it is based on modified radio control servos typically used in hobbyist applications. These components can be integrated into a computer controlled pan/tilt base that is low cost and reliable. The mounting structure, control electronics and software to create a variable speed, high performance pan/tilt platform with preset capability that has proven to be low cost and reliable.

In one embodiment, the tracking sensor is a digital charge couple device array sensor (CCD). Old sensor data is compared with new sensor data to detect changes in the environment. The tracking sensor information is processed by the computer and the pan/tilt/zoom camera is directed to the area of motion. The system can be programmed to track multiple targets and also zoom in on salient features that can help identify the subject. This greatly simplifies the task of a human operator monitoring a multiple camera surveillance system. In one configuration, instead of having to watch several displays for activity, only the cameras which have activity are displayed for the human operator to review.

Another element in the design is the data network which integrates the robotic cameras. The robotic camera employs video compression techniques to minimize the bandwidth requirement of the network. There are two data streams from the robotic camera. The first contains the information from the pan/tilt/zoom camera and the second is the information from the tracking sensor. The first data stream from the video camera can be reviewed over the data network in real-time, or sent to an archival video storage resource. The second data stream is much smaller than the camera video since the data coming from the tracking sensor can be monochrome, have lower spatial resolution and have less greyscale accuracy than the pan/tilt/zoom camera. Over a 100-to-1 data reduction can be achieved even without compression techniques being employed.

The system also facilitates teleoperation of video cameras over data networks. The robotic camera modules can send the tracking sensor data along with the camera video. The sensor data in combination with a point, click and drag interface allows the user to quickly pan, tilt and zoom any camera on the network. The operator has the option of teleoperating any of the cameras to collect specific views. Pointing and clicking on the tracking sensor display directs the camera to point at that coordinate. Dragging the mouse results in a rectangle being drawn around the target coordinate. The area contained within the rectangle defines the zoom setting of the camera and corresponds to the view delivered by the video camera.

Ultimately, the above elements are combined to create a robotic camera to be utilized in a digital surveillance network. The robotic camera is easy to install and use, light weight, compact, and low power. In addition to the refueling station, it can be employed to monitor spaces like commercial buildings, parking lots, prisons, etc., and can even be used as part of a home security system. It is also ideal for use in temporary surveillance situations or for portable applications.

Figure 10:
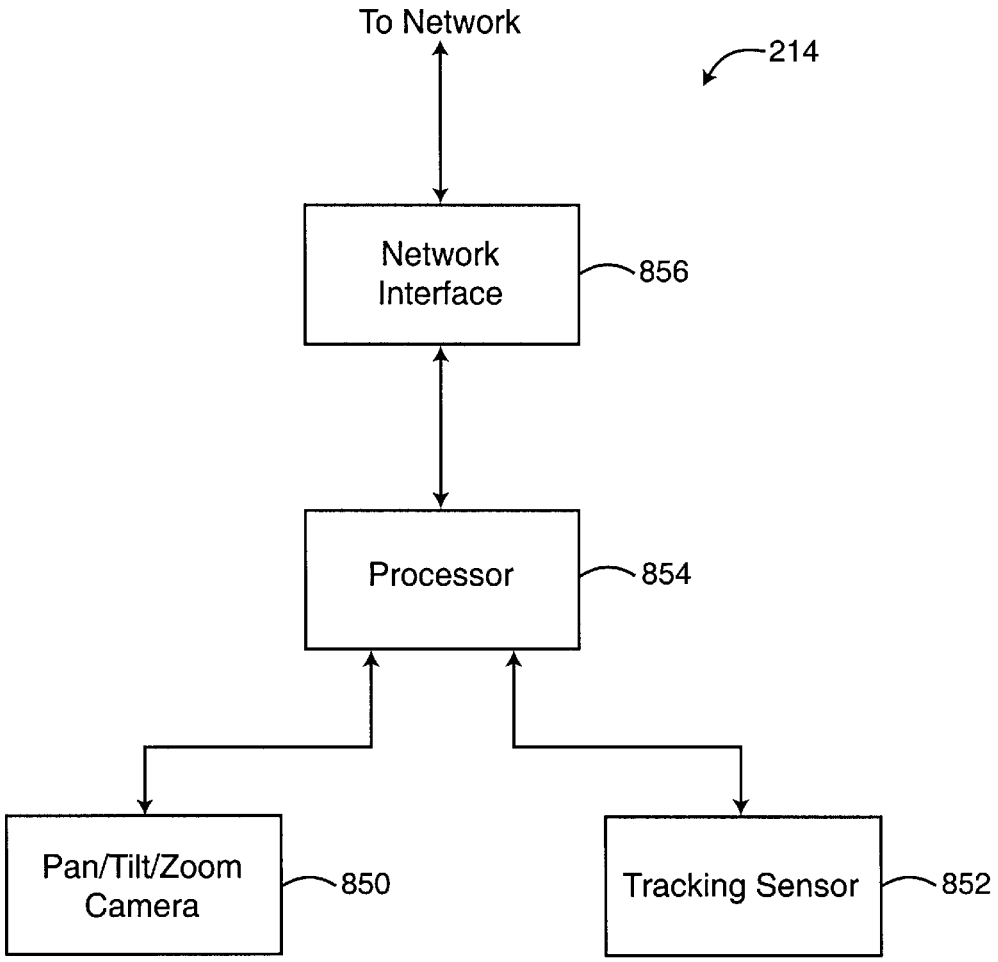
FIG. 10 contains a schematic block diagram of one embodiment of a robotic camera used in a vision system in accordance with the present invention.

FIG. 10 contains a schematic block diagram of one embodiment of the robotic camera module 214. It includes a servo pan/tilt/zoom camera 850, a digital CCD array tracking sensor 852, a microcomputer or processor 854 and a network interface 856.

Figure 11:
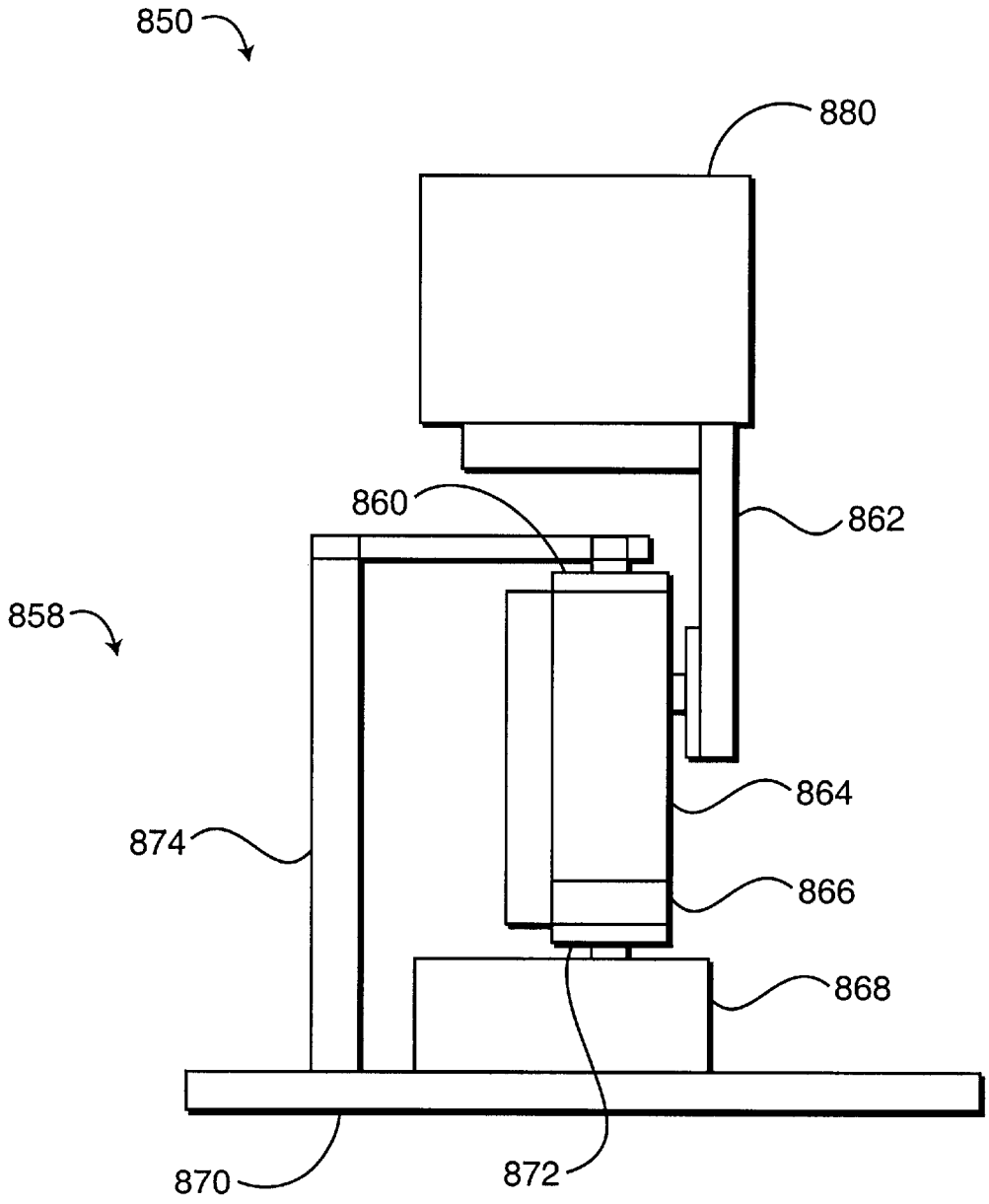
FIG. 11 contains a schematic diagram of one embodiment of a pan/tilt base used with a pan/tilt/zoom camera in accordance with the present invention.

One implementation of a pan/tilt base can be made using two radio control servos mounted orthogonally to each other as shown in FIG. 11, which contains a schematic diagram of the pan/tilt base 858 of the pan/tilt zoom camera 850. These servo actuators are low-cost, compact, designed for high vibration environments, and are available with a wide variety of motors and bearings. The pan actuator 868 is secured to a base plate 870 with mounting screws. The tilt actuator 864 is attached orthogonally to the output shaft 872 of the pan actuator 868 using a joining bracket 866. A shaft and bearing assembly 860 is attached to the top of the tilt actuator 864. The bearing assembly 860 is secured to a bearing support 874 and is held in a position that is in line with the center of rotation of the pan actuator 872. The bearing 860 is used to improve the stability and stiffness of the device. A camera bracket 862 which holds the motorized zoom camera 880 is attached to the output shaft of the tilt actuator 864. An optional torsion spring can be attached to the output shaft of the tilt actuator 864 to help counterbalance heavier loads against gravity. Referring again to FIG. 10, the processor 854 provides the required pulse width modulated (PWM) drive signals for the camera 850 and provides a serial interface for communications and control.

In one embodiment, the tracking sensor 852 is an optical CCD array sensor with a digital interface. It is coupled with wide angle optics to provide a panoramic view of the area being monitored. The tracking sensor 852 typically has a field of view that can range from 60 to 180 degrees. Multiple sensors can be employed to provide 360 degree coverage. One embodiment of the tracking sensor is a digital CCD array sensor with a spatial resolution of 160×120 and four bits of greyscale resolution for 16 levels of grey. Lower cost, faster processing, and better low-light sensitivity are achieved by using a low-resolution monochrome CCD sensor. The data from this sensor is used in both the detection and tracking processes, and in the teleoperator user interface.

The tracking sensor 852 continually scans the area being observed to detect greyscale changes in the environment. The camera 850 is directed to point at and zoom into anything that moves within the detection area. This can be any part of the body (hands, head, feet etc.) or the entire body. The software is designed to vary the zoom level in order to capture both wide angle and telephoto views of the subject. Thus it aids in identifying the suspect by recording identifying features such as rings on hands, articles of clothing, facial features, etc. A common deficiency of conventional surveillance systems is the inability to resolve sufficient details of a suspect to aid in the identification.

The system is also effective at monitoring multiple individuals entering the area being observed. Once a difference is detected, it is located and the coordinates are fed to the pan/tilt controller to direct the camera and zoom motor. This trigger condition can also cause the camera information to be sent along with the tracking sensor information for further review by a human operator. In situations where there is limited bandwidth available, a video compression codec (hardware or software) can be utilized.

The tracking sensor 852 detects changes in the environment by comparing prior greyscale readings with current readings. The control computer 854 assesses the change data from the tracking sensor 852 and centers the pan/tilt/zoom camera 850 on the object in motion. The sensor data is evaluated from the top down and from the outer edges in. The vertical coordinate is derived from the vertical position of the first detected change. The horizontal coordinate is derived from the average of the left and right edges of the detected change. The zoom value is derived by subtracting the right edge value from the left. A larger value results in a wider setting on the zoom lens. An ultrasonic or infrared range finder can also be employed to assist in the calculation of an optimal zoom setting. For example, a small detected change and a distant range value would confirm the need for the camera to zoom in. However, a small detected change and close range value would cause the camera to zoom in less than in the prior situation. If needed, a high pass digital filter can be used to enhance the edge data in order to better determine the edges of the moving object.

In one embodiment, the detection and tracking procedure is weighted toward giving priority to objects at the top of the sensor screen over objects that are moving at the bottom of the sensor screen. The system scans for motion from the top down and directs the camera toward the motion. In most cases this would be the head or face of the subject in motion. However, in the case where the head is stationary and the hand, or foot or torso is in motion then the camera zooms into that area. This is precisely the kind of information that is desirable for security applications where close up views of footwear, rings, tattoos, clothing and other distinguishing marks can aid in the identification of a suspect. Our test results indicate this algorithm will normally point the camera at a person's face when the entire body is in motion. However, when the head is stationary and other parts of the body are in motion (e.g., hands, feet, etc.) then the camera will zoom in on the part in motion, giving the operator a view of other identifying characteristics such as jewelry or clothing. When more than one person is in motion at one time, the camera will zoom out to display everyone. If there are multiple individuals that move at different times, the camera will zoom in and will point at the person who is currently in motion. In applications, such as the refueling station of the invention, where it is required to detect moving objects and identification of persons is not critical, this top down scanning, which prioritizes the top of the field of view, can be deactivated.

Alternative strategies that can be employed include blob analysis, autocorrelation pattern matching, and other conventional image tracking algorithms. Expert system and neural network programming can be employed to interpret the raw data and better extract the motion information. False alarms from shadows or variable lighting can be reduced in this manner. The distributed network aspect of the invention makes it easy to dynamically vary the procedures employed by the robotic cameras to achieve optimal performance.

In one embodiment, the tracking sensor 852 and pan/tilt/zoom camera 850 should be as close as physically possible. However, any offset can be mathematically or table-lookup compensated. The system can automatically calibrate the tracking sensor 852 with the pan/tilt/zoom camera 850. A laser module can be mounted on the pan/tilt platform to paint a dot on the scene that can be seen by the tracking sensor 852. The control computer 854 can then scan the pan/tilt platform and note the corresponding output from the tracking sensor 852. A calibration table can be derived from this process. This procedure is particularly useful when high accuracy is desired or when there is a need to compensate for distortion in the tracking sensor optics, e.g., a fisheye lens.

The tracking sensor information is useful for teleoperating the video camera. The user can point, click and drag on the sensor display to cause the camera to pan/tilt and zoom. The camera is directed to a new position when the operator places the mouse cursor on the sensor display. The operator can set the zoom setting by dragging the cursor away from the original point of contact. The further away from the original point of contact, the wider the zoom setting. The operator is assisted with a superimposed overlay of a rectangle on the tracking sensor display that depicts the approximate field of view that has been commanded. Once the zoom setting has been established the user can cause the camera to follow the intruder by simply clicking on the sensor display and following the intruder with the cursor. Multiple sensor displays and camera displays can be shown on a single monitor to further facilitate the control and monitoring of multiple cameras.

The robotic camera control interface of the invention provides a faster and more efficient control of the pan/tilt/zoom camera than other conventional systems. Most conventional interfaces utilize joysticks which require the user to attempt to track an intruder, or buttons on a computer display which control each axis independently. Another approach uses a point and click interface that uses the image from the pan/tilt/zoom camera. However, it is deficient when the camera is already zoomed in because the operator is unaware of any events outside of the zoomed field of view. The operator is first required to zoom out before redirecting the camera.

Figure 12:
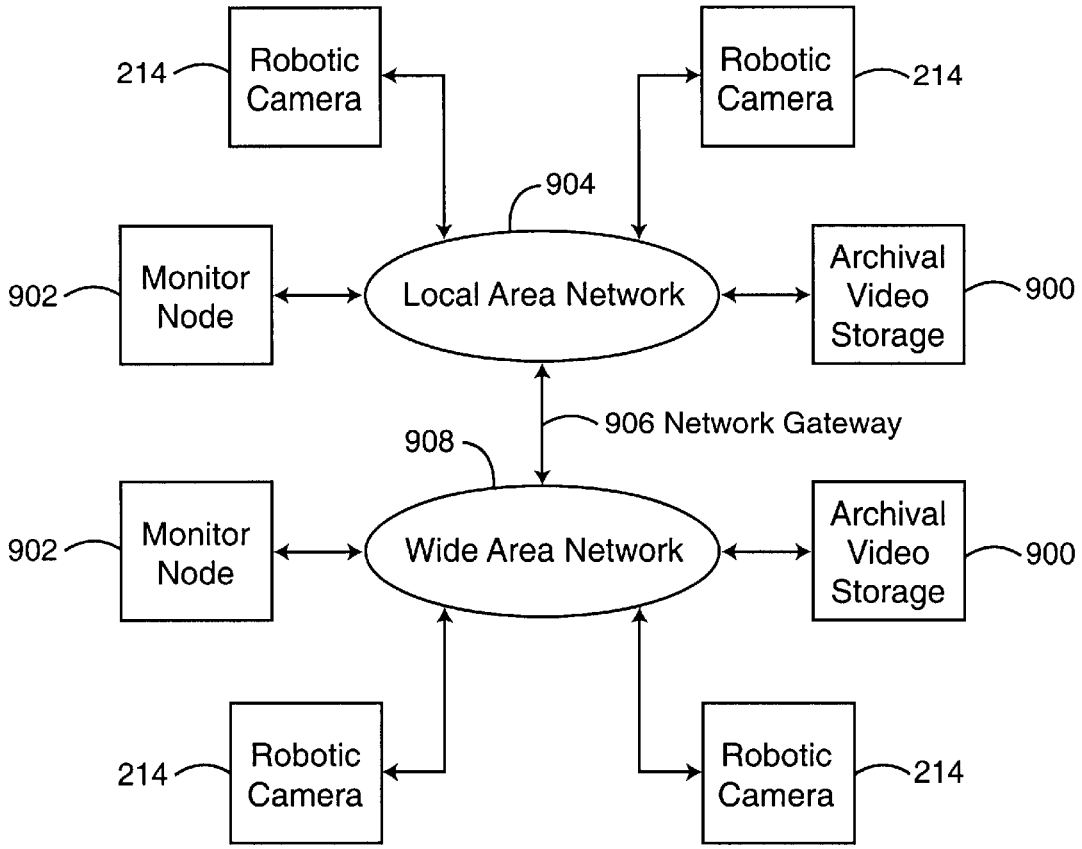
FIG. 12 contains a schematic functional block diagram of a network used to link components of a vision system in accordance with the present invention.

In one embodiment, the vision system utilizes a digital data network to link the various system components instead of an analog multiplexer to obtain different camera views. FIG. 12 contains a schematic functional block diagram showing the network used to link the components of the vision system of the invention. The system shown in FIG. 12 includes a local area network (LAN) 904 linked to a wide area network (WAN) 908 by a network gateway 906. The LAN 904 links multiple cameras 214, archival video storage 900 and a monitor node 902. The WAN 908 also links multiple cameras 214, archival video storage 900 and a monitor node 902.

This approach also allows the robotic cameras 214 to share information with each other to coordinate efforts and to send information directly to digital archival storage units 900. This fully digital implementation is more flexible, and easier to install, and data storage is more efficient through the use of compression techniques, e.g., MPEG. This approach is designed to take advantage of the wide variety of data networks being developed to support Internet and Intranet traffic. This system can also operate with radio frequency wireless networks and opens up the possibility of mobile robotic cameras for surveillance applications.

Other applications for the vision system use additional tracking sensors, use the tracking sensor without the pan/tilt/zoom camera, use the tracking sensor with other devices instead of pan/tilt/zoom cameras, or use additional complementary sensors and actuators. For example, additional tracking sensors can be deployed in a area and a robotic camera can be mounted on a gantry or track assembly so that a target can be followed throughout an environment. In this way one robotic camera could be used to provide total coverage of an area. Similarly, the robotic camera can also be mounted on a mobile base and the tracking sensors can serve as a guidance system for the mobile robotic camera.

The motorized pan/tilt platform in the invention can also be used to support other devices besides a zoom camera. Directional microphones can be employed for audio surveillance, light sources can be used for automated lighting control, or laser pointers could project a spot for targeting purposes. The invention can also be used to control less passive devices such as paint ball guns to mark intruders, high intensity strobe lights to temporarily blind intruders, or air TASER style stun guns. Other sensors such as an ultrasonic or infrared ranging device can be used to determine the distance to a target.

The invention can be modified for use in videoconferencing applications like distance learning or telemedicine. An infrared pass filter can be placed in front of the tracking sensor to enhance the infrared signal and cut down on the background lighting. An infrared cut filter can be placed in front of the video camera to block out the infrared emitter signal. The system could then track an infrared emitter whenever it is powered. In a videoconferencing presentation the presenter could wear a "necklace" of infrared emitting diodes that illuminate and highlight the head and face of the speaker, or in a classroom environment a group of students can each have an infrared transmitter and can summon the camera by activating the transmitter. Telemedicine applications range from the simple monitoring of patients in hospital rooms to the use of dual video cameras to support stereo vision in teleoperated surgical procedures. The teleoperator user interface can be used for both near and far camera control in videoconferencing.

The teleoperator user interface of the vision system can be utilized in broadcast studio control rooms. Multiple cameras can be positioned and zoom settings can be established as part of a typical television broadcast. The robotic camera user interface greatly simplifies the task of controlling and coordinating multiple cameras with a point and click approach. It is easier to use and requires fewer user operations than any current offering.

Other applications include the remote monitoring of home based elderly. Nursing home care is generally considered a last resort and can be expensive. It is desirable to extend the time that a person can live safely and independently in his or her own home. The invention makes it easier for health care providers to check on the health and well being of the home bound elderly. It can also automatically detect when there might be a problem. The system can learn the typical patterns of the day to day activities. For example, it can know when the homeowner usually wakes up, it can tell whether the homeowner has entered the bathroom recently, and it can tell if the homeowner may have fallen and can't get up. If there is a significant deviation from the usual pattern, then it will first attempt to communicate with the homeowner. If there is no response, it will notify a care giver to check in on the homeowner. The invention can significantly delay the need for nursing home care.

The overcrowding of prisons is making home based incarceration of non-violent prisoners more common. Radio based tracking ankle bracelets have been shown to fail or be easily circumvented. The invention can be utilized to ensure the prisoner complies with the terms of the agreement. Prison representatives can readily monitor the prisoner at any time, and the invention can also notify authorities of any anomalous activities.

The relative low cost of the invention, its compact size, ease of installation, and flexibility make it an ideal candidate for use in home automation applications. It creates the possibility of multi-functionality, where the same equipment can be used for security, videoconferencing, and home automation. For example, the robotic cameras could perform a security function during the night, but serve as a videotelephone and lighting controller during the day. The invention can serve as a video phone that automatically centers and frames the speakers optimally, and can point a directional microphone in the direction of the speaker. The invention can turn lights on and off whenever a homeowner enters or leaves a room, or it can spotlight an intruder in the home. It can direct a reading spotlight onto the left side or right side of a sofa depending on where the homeowner is sitting or zoom the light out if two people are detected.

The system also facilitates the use of voice commands in the home. An adjustable gain directional microphone can be directed toward the speaker by the invention thereby reducing background noise and increasing the probability of speech recognition. The amplifier gain can be set higher if the homeowner is far away from the microphone and set lower if nearby. In this situation the microphone will likely be paired with an ultrasonic range finder to help determine the distance to the homeowner.

The tracking sensors can be utilized to guide mobile robots for vacuum cleaning and lawn mowing. A radio frequency network link can be maintained between the mobile robots and the robotic cameras to ensure that no surface areas are missed and that mobile robots don't exceed the proscribed boundaries.

Outdoor applications include monitoring of unauthorized access to a swimming pool. Again, multiple sensors can be employed to enhance the performance of the system. This is a situation where a broad area sensor and a more focused sensor used in combination can yield significant benefits. For example, the tracking sensor may be fooled by shadows from clouds or ripples in the pool water. However, an alarm event can be corroborated by a directional microphone that requires there be the sound of splashing before triggering an alarm condition.

Another outdoor application is animal pest control in the garden. The invention can be used in conjunction with an infrared illumination source to detect animals which pilfer from the garden. They can then be repelled with a flash of light, a shot of pepper spray or a harmless water spray.

One embodiment of the tracking sensor is a monochrome digital CCD sensor chip with wide angle lens, interfaced to a microprocessor. However, virtually, all frequencies of the electromagnetic spectrum can be utilized for tracking purposes. For example, a tracking sensor can utilize ultrasonics like a bat or radar like a missile defense system. The current embodiment uses a monochrome sensor but some applications may be best served with a color sensor. Dual sensors can be utilized to extract stereo depth information from a scene for use in tracking. Structured light techniques can be used to enhance the performance of the sensor and to allow it to operate in total darkness. An array of pyroelectric sensors can be used to sense the presence and location of a person from the emitted body heat. Alternate embodiments also include conventional analog video cameras utilizing a frame capture board.

In the current embodiment, the tracking sensor information is processed locally. However, the tracking sensor information may also be sent over the network for processing on a central computer. This would require a fast network and a fast computer.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. An apparatus for automatically refueling a vehicle comprising:

A. a detector configured to receive a vehicle information message from said vehicle and to derive a vehicle identification from the vehicle information message;

B. means for accessing a database of stored data related to a plurality of vehicles to obtain vehicle data related to the vehicle as a function of said vehicle identification;

C. a fuel filler door system configured to facilitate opening a fuel filler door of said vehicle; and D. a refueling module configured to automatically refuel the vehicle as a function of the vehicle data;

wherein the stored data comprises information related to a fuel fill rate for the vehicle.

2. The apparatus of claim 1 wherein the refueling module comprises means for refueling the vehicle at an optimized fuel fill rate based on the information related to the fuel fill rate for the vehicle.

3. The apparatus of claim 1 wherein the stored data comprise information related to a location of a fuel fill cap on the vehicle.

4. The apparatus of claim 3 wherein the refueling module uses the information related to the location of the fuel fill cap to locate the fuel fill cap on the vehicle.

5. The apparatus of claim 1 wherein the information received from the vehicle comprises billing information for a customer associated with the vehicle.

6. The apparatus of claim 1 wherein the vehicle information message received from the vehicle comprises information that identifies a customer associated with the vehicle.

7. The apparatus of claim 6 further comprising means for accessing a database of stored data related to a plurality of customers to obtain data related to billing information for the customer.

8. The apparatus of claim 1 further comprising a vision system for locating a fuel fill cap of the vehicle.

9. The apparatus of claim 1 further comprising a vision system for monitoring a position of the vehicle.

10. The apparatus of claim 1 further comprising a vibration sensing system for determining whether an engine of the vehicle is running.

11. The apparatus of claim 1 further comprising an acoustic sensing system for determining whether an engine of the vehicle is running.

12. The apparatus of claim 1 further comprising a sonar sensor for monitoring a position of the vehicle.

13. The apparatus of claim 1 further comprising an infrared sensor for monitoring a position of the vehicle.

14. The apparatus of claim 1 further comprising a radio frequency transponder mountable in the vehicle from which the information used to identify the vehicle is detected.

15. The apparatus of claim 1 wherein the refueling module comprises a robotic arm for positioning a fuel fill nozzle to refuel the vehicle.

16. The apparatus of claim 15 further comprising means for varying a fuel flow rate through the nozzle.

17. The apparatus of claim 15 further comprising a vision system used by the refueling module to control the robotic arm to position the fuel fill nozzle the refuel the vehicle.

18. The apparatus of claim 15 wherein the refueling module comprises a force sensor for sensing force on the robotic arm while the nozzle is being positioned.

19. The apparatus of claim 18 wherein the force sensor is at least partially located on the robotic arm.

20. The apparatus of claim 15 wherein the refueling module comprises a camera for generating an image used in positioning the nozzle.

21. The apparatus of claim 20 wherein the camera is located on the robotic arm.

22. The apparatus of claim 15 wherein the refueling module comprises an infrared sensor used in positioning the nozzle.

23. The apparatus of claim 22 wherein the infrared sensor is at least partially located on the robotic arm.

24. The apparatus of claim 15 wherein the refueling module comprises a sonar sensor used in positioning the nozzle.

25. The apparatus of claim 24 wherein the sonar sensor is at lease partially located on the robotic arm.

26. The apparatus of claim 15 wherein the refueling module comprises a magnetometer used in positioning the nozzle.

27. The apparatus of claim 26 wherein the magnetometer is located on the robotic arm.

28. The apparatus of claim 26 further comprising a gas fill cap comprising a magnet, said magnet being sensed by the magnetometer as the nozzle is positioned.

29. The apparatus of claim 15 wherein the refueling module comprises a hall effect sensor used in positioning the nozzle.

30. The apparatus of claim 29 wherein the hall effect sensor is located on the robotic arm.

31. The apparatus of claim 15 wherein the refueling module comprises a torque sensor for sensing torque on the robotic arm while the nozzle is being positioned.

32. The apparatus of claim 31 wherein the torque sensor is at least partially located on the robotic arm.

33. The apparatus of claim 1, wherein said fuel filler door system includes a fuel filler door opener.

34. The apparatus of claim 1 wherein the fuel filler door system comprises a vision system for locating the fuel filler door.

35. The apparatus of claim 1 wherein said fuel filler door system includes a fuel filler door closer.

36. The apparatus of claim 1 wherein said fuel filler door system includes a fuel filler door release notification mechanism, configured to notify an operator of said vehicle to release said fuel filler door, when said vehicle data includes information indicating that said vehicle includes an operator controllable fuel filler door release, internal to said vehicle.

* * * * *